US011511210B2

(12) United States Patent
Gat

(10) Patent No.: US 11,511,210 B2
(45) Date of Patent: Nov. 29, 2022

(54) CUBIC ELEMENT FOR CONSTRUCTION TOYS AND A METHOD FOR FORMING SAME

(71) Applicant: Daniel Gat, Tel Aviv (IL)

(72) Inventor: Daniel Gat, Tel Aviv (IL)

( * ) Notice: Subject to any disclaimer, the term of this patent is extended or adjusted under 35 U.S.C. 154(b) by 0 days.

(21) Appl. No.: 17/250,155

(22) PCT Filed: Jun. 19, 2019

(86) PCT No.: PCT/IL2019/050683
§ 371 (c)(1),
(2) Date: Dec. 7, 2020

(87) PCT Pub. No.: WO2020/003300
PCT Pub. Date: Jan. 2, 2020

(65) Prior Publication Data

US 2021/0245037 A1 Aug. 12, 2021

Related U.S. Application Data

(60) Provisional application No. 62/689,178, filed on Jun. 24, 2018.

(51) Int. Cl.
*A63H 33/06* (2006.01)
*A63F 9/20* (2006.01)
*A63H 33/08* (2006.01)

(52) U.S. Cl.
CPC ..... *A63H 33/062* (2013.01); *A63F 9/20* (2013.01); *A63H 33/084* (2013.01)

(58) Field of Classification Search
CPC ..... A63H 33/06; A63H 33/065; A63H 33/08; A63H 33/082; A63H 33/084; A63H 33/086; A63F 9/20
USPC ..... 446/120, 121, 124, 125, 126, 127
See application file for complete search history.

(56) References Cited

U.S. PATENT DOCUMENTS 319,764 A * 6/1885 Wescott ..... A63H 33/084 52/591.1
1,882,607 A * 10/1932 Howard ..... A63H 33/04 446/127
3,139,698 A * 7/1964 Arnold ..... A63H 33/084 446/124
3,360,883 A 1/1968 Glanzer
3,449,857 A * 6/1969 De Christopher ..... A63H 33/08 446/124
3,660,928 A * 5/1972 Michel ..... A63H 33/084 446/124

(Continued)

FOREIGN PATENT DOCUMENTS

FR 2774305 A1 8/1999

*Primary Examiner* — Joseph B Baldori
(74) *Attorney, Agent, or Firm* — Wolter Van Dyke Davis, PLLC; Eugene J. Molinelli; Patrick Herron

(57) ABSTRACT

The present invention relates to a cubic element for construction toys, including three, straight, open-ended channels each formed on an adjacent different face of the cube between two opposite faces of the cube and extending in orthogonal opposite directions to each other (X,Y,Z). Each channel includes a bottom wall and two upwardly extending parallel sidewalls, wherein the width of the bottom wall and the distance between the face which is distal to the channel that is extending orthogonally from the same cube face, and the sidewall adjacent the distal face, are substantially equal.

15 Claims, 6 Drawing Sheets

(56) References Cited

U.S. PATENT DOCUMENTS 3,678,613 A * 7/1972 Geymeier ..... A63H 33/088 446/124
3,827,695 A 8/1974 Hess
3,838,535 A * 10/1974 Larws ..... A63H 33/084 446/124
3,919,785 A 11/1975 Generaux
4,202,131 A * 5/1980 Poleri ..... A63H 33/082 446/125
4,381,619 A 5/1983 Griffin
4,932,812 A * 6/1990 Schaaf ..... E02D 29/025 405/286
5,267,863 A * 12/1993 Simmons, Jr. ..... A63F 9/0613 434/96
5,273,477 A * 12/1993 Adams, Jr. ..... A63H 33/04 446/108
5,775,046 A * 7/1998 Fanger ..... A47B 81/061 108/158.12
7,198,270 B1 * 4/2007 Bishop ..... A63F 9/12 273/156
7,988,516 B2 * 8/2011 Bishop ..... A63H 33/082 446/124
9,238,179 B2 * 1/2016 Carpenter ..... A63H 33/082
9,492,734 B2 * 11/2016 Boulding ..... A63F 9/1208
10,456,702 B2 * 10/2019 Dumphy ..... A63H 33/08
10,724,240 B2 * 7/2020 Brandao ..... E04B 2/18
10,926,185 B1 * 2/2021 Pihl ..... A63H 33/086
2004/0102132 A1 * 5/2004 Miller ..... A63H 33/082 446/125
2004/0121699 A1 * 6/2004 Ladner ..... A63H 33/082 446/85
2008/0280523 A1 11/2008 Bishop
2008/0299868 A1 * 12/2008 Chungpaiboon ..... A63H 33/08 446/69
2017/0203226 A1 * 7/2017 Dorasamy ..... A63H 33/086
2018/0313377 A1 * 11/2018 Balint ..... G06F 3/033
2019/0059578 A1 * 2/2019 Inoue ..... A47B 47/047
2020/0171400 A1 * 6/2020 Felix ..... A63H 33/082
2021/0086096 A1 * 3/2021 Fang ..... A63H 33/086
2021/0238846 A1 * 8/2021 Zhang ..... E04B 2/32

* cited by examiner

CUBIC ELEMENT FOR CONSTRUCTION TOYS AND A METHOD FOR FORMING SAME

FIELD OF THE INVENTION

The present invention relates to the art of construction or assembly toys particularly for children enabling them to build a variety of fancy models or structures.

BACKGROUND OF THE INVENTION

Construction toys play a major part in the development of the imaginative, cognitive, motoric and other faculties of young players. Countless number of such toys have been introduced into the market-place in the last century.

As a rule, the traditional toys were composed of differently designed basic elements. Efforts have been made to minimize the number of non-identical elements. For example, in U.S. Pat. No. 3,360,883 dated Jan. 2, 1968 (to Glanzer et al) it has been stated as follows (see annexed FIG. 1):

"The main object of the present invention consists in providing a composite toy easy to assemble, so that it can be used by children of even very young age, the toy offering the possibility for building-up a large variety of structures with practically only three basic elements.

The composite toy according to the present invention is inexpensive due to the fact that it comprises only two structurally different connecting pieces of identical outer dimensions and a plurality of cylindrical rods of various lengths, but nevertheless gives the user a possibility for building-up very complex structures." (Col, 1, II. 51-62—emphasis added)".

Glanzer et al further discloses that in order to be useful as a construction toy piece, the cube as described and claimed by this patent must be made of a resilient material such as polyethylene (Col. 2 II. 8-9).

It is thus an object of the present invention to still further reduce the number of differently designed construction elements, namely to only a single element.

Yet another object of the present invention is to use the this single construction element to form structures that adhere to the rules of the well-known game "Dominoes" or new rules based on the same principle, so as to create a novel 3D "Dominoes" game.

It is therefore a long felt need to provide a construction toy that is based on a single object and a method of forming same, and contributes to the development of the imaginative, cognitive, motoric and other faculties of young players, and additionally be used to create a new of Dominoes game which provides many new and more challenging possibilities for the players of this game.

BRIEF DESCRIPTION OF THE DRAWINGS

Some preferred embodiments of the invention will be exemplified by the following description, with reference to the annexed drawings, wherein—

SUMMARY OF THE INVENTION

Figure 1:
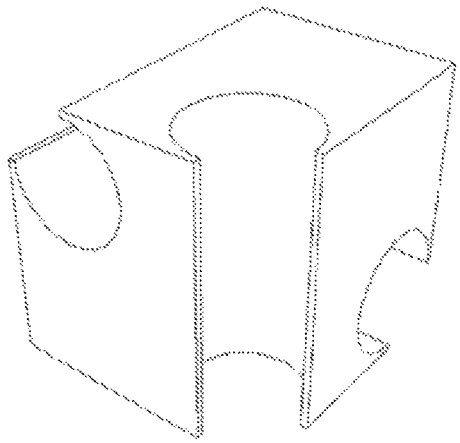
FIG. 1 (PRIOR ART)
FIG. 1 represents the prior-art reflected by the above-mentioned US Patent.

The present invention relates to a cubic element for construction toys, including three, straight, open-ended channels each formed on an adjacent different face of the cube between two opposite faces of the cube and extending in orthogonal opposite directions to each other (X,Y,Z). Each channel includes a bottom wall and two upwardly extending parallel sidewalls, wherein the width of the bottom wall and the distance between the cube face which is distal to the channel that is extending orthogonally from the same cube face, and the adjacent sidewall, are substantially equal.

According to some embodiments of the invention, there is thus provided a cubic element for construction toys, including three, straight, open-ended channels each formed on an adjacent different face of the cube and extending in orthogonal opposite directions to each other (X,Y,Z). Each of the first, second and third channels, formed on the first, second and third faces, respectively, is having a bottom wall, a first sidewall and second parallel sidewall distant from the first sidewall, and is extending between a first pair of opposing faces of the first, second and third faces, respectively, and is disposed in parallel to a second pair of opposing faces of the first, second and third faces, respectively.

According to some embodiments of the invention, the distance between the first sidewall and second sidewall in each of the first, second and third channels, and the distance between a face of the second pair of opposing faces, distal to the channel that is extending orthogonally from same face, and the adjacent sidewall are equal. According to embodiments of the invention, the first sidewall of each channel of the cubic element is extending upwardly from the bottom wall and the second sidewall is extending upwardly from the bottom wall. The first sidewall of each of the first, second and third channels, and the face of the second opposing faces of each of the first, second and third faces, respectively, distal to the channel extending orthogonally from each of these faces, respectively, form a ridge with the first sidewall, that is sized and configured to snuggly-fit or snap-fit in each of said channels, respectively.

According to preferred embodiments of the invention the first and second sidewalls of each of the channels, is extending upwardly in perpendicular to the bottom wall and each ridge is having a width substantially equal to the distance between the first and second sidewalls of each channel, and sized and configured to snuggly fit or snap-fit in each of the channels, respectively.

According to preferred embodiments of the invention the cubic element comprises three identical sections attached to each other, wherein each section includes a first flat wing integrally formed with the section, a second profiled wing integrally formed with the section, a first and second pins juxtaposed and disposed at the internal side of the section, a third pin disposed diagonally opposite the first and second pins on the internal side of the second wing, wherein the distance between the first and second pins on each section is sized and configure so as to receive in a snap-fit manner the third pin of another section upon the assembling of each section to another section.

According to preferred embodiments of the invention, at least one of the channel sidewalls is formed with at least one flexible tongue projecting from the sidewall surface inward the channel. The tongue may be integrally formed with its respective sidewall.

The present invention further relates to a Dominoes game including a set of cubic elements according to the present invention. Each cube element is including at least one spot marked on each face of the cube element or no spot, at least one rule configured and adapted by the manufacturer of the Dominoes game for playing the game. A first cube element interlocks with a second cube element by snug fitting or snap-fitting the ridge of the first cube element into the channel of the second cube element, so as to align at least one face of the first cube element with at least one face of the second cube element wherein these faces are having an identical at least one spot or no spot.

There is also provided, according to the invention, a method for forming a cubic element, the method including providing a first element section having a first flat wing integrally formed with said section, a second profiled wing integrally formed with said section, a first and second pins juxtaposed and disposed at the internal side of said section, and a third pin disposed diagonally opposite said first and second pins on the internal side of said second wing, sizing and configuring the distance between said first and second pins on each of said sections so as to receive in a snap-fit manner said third pin of another of said section, providing a second said element section, assembling an assembly of said first said section to said second said section, providing a third said element section and assembling said third section to said assembly.

DETAILED DESCRIPTION OF THE PREFERRED EMBODIMENTS

The following description is provided, alongside embodiments of the present invention, to enable any person skilled in the art to make use of said invention and sets forth the best modes contemplated by the inventor of carrying out this invention. Various modifications, however, will remain apparent to those skilled in the art, since the generic principles of the present invention have been defined specifically to provide a cubic element for a construction toy that interlocks with another cubic element of an identical structure. Additional features and advantages of the invention will become apparent from the following drawings and description.

The present invention relates to a cubic element for a construction toy. The cubic element according to an embodiment of the invention, is illustrated in FIGS. 2*a* to 2*d* where it is generally designated C, and measures L×L×L. At three adjacent sides of the cube there are formed channels denoted X, Y and Z, respectively, extending from side to side of two opposing cube external surfaces, each channel along the orthogonal axes X, Y and Z and in parallel to the edge of their respective side of the cube C. The channels are located each at a distance 'a' from the plane of symmetry of their respective cube-side.

In more detail, according to the embodiment of the invention depicted in FIGS. 2*a* to 2*d*, at the first cube face Fa of cube C there is formed a straight, open-ended channel generally denoted X, extending between a first pair of opposing cube faces Fb and Fc and disposed in parallel to a second pair of opposing cube faces Fd and Fe. At a second cube face Fb of cube C adjacent face Fa there is formed a straight, open-ended second channel, generally denoted Y, orthogonal to channel X and extending between the pair of cube faces Fd and Fe and in parallel to opposing cube faces Fa and Ff. At a third cube face Fd of cube C adjacent both face Fa and face Fb, there is formed a straight, open-ended third channel, generally denoted Z, orthogonal to both channel X and channel Y, extending between the pair of cube faces Fa and Ff and in parallel to cube faces Fb and Fc. Each of channels X, Y and Z is having a substantially equal width 'a' and is disposed, at a distance that is substantially equal to the width 'a' of the channels, from the cube face, distal to the channel extending orthogonally from the same face, e.g. channel X is disposed a distant 'a' from cube face Fe.

Figure 2A:
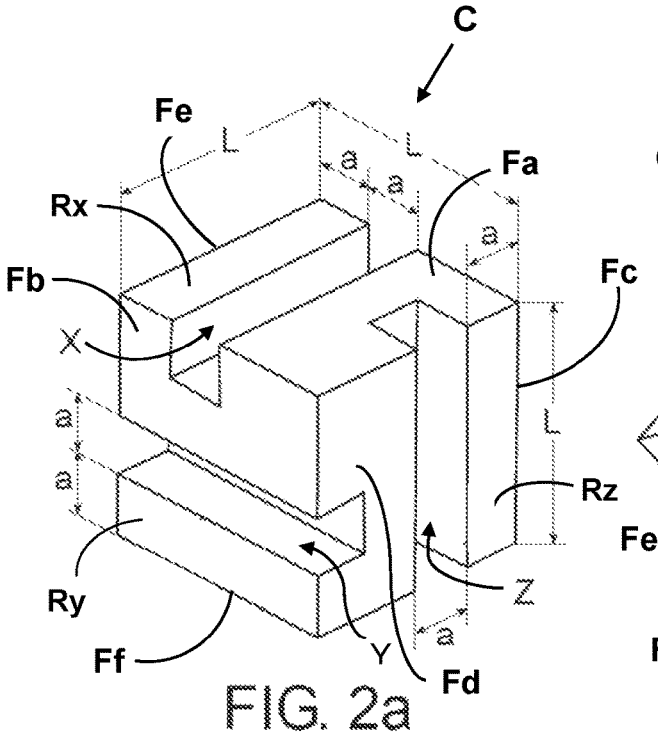
FIG. 2*a* is a three-dimensional isometric projection view of a cubic element according to a first preferred embodiment of a the present invention.
Figure 2B:
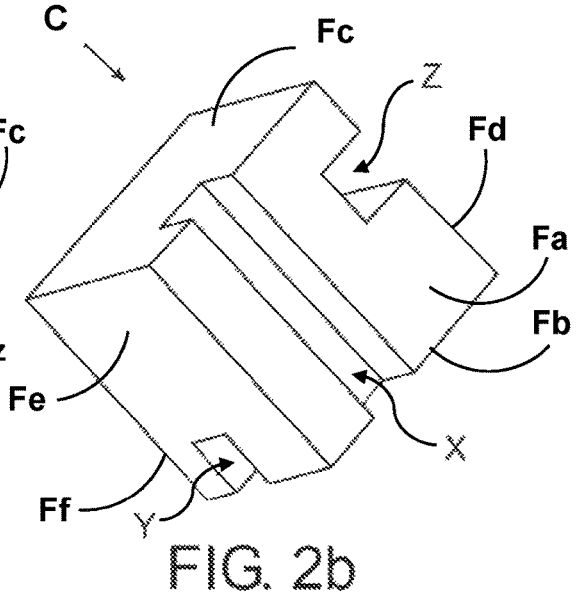
FIG. 2*b* is a three-dimensional isometric projection of the element of FIG. 2*a* seen in a rotated position.
Figure 2C:
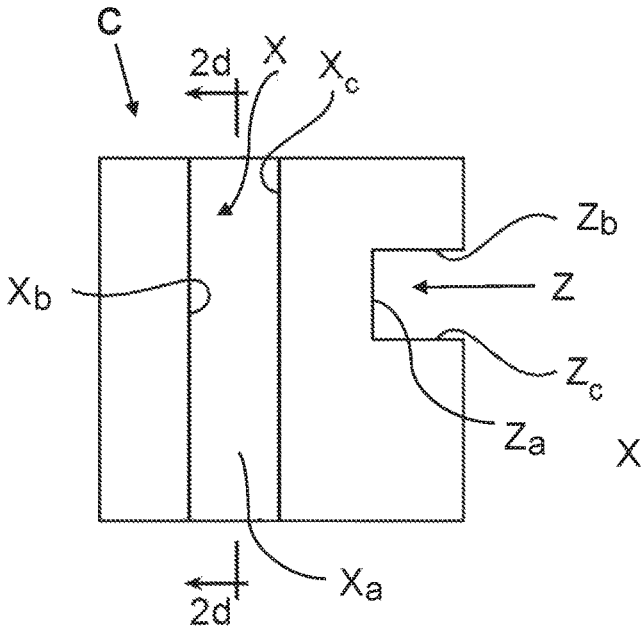
FIG. 2*c* is a top view of the element of FIG. 2*a;*
Figure 2D:
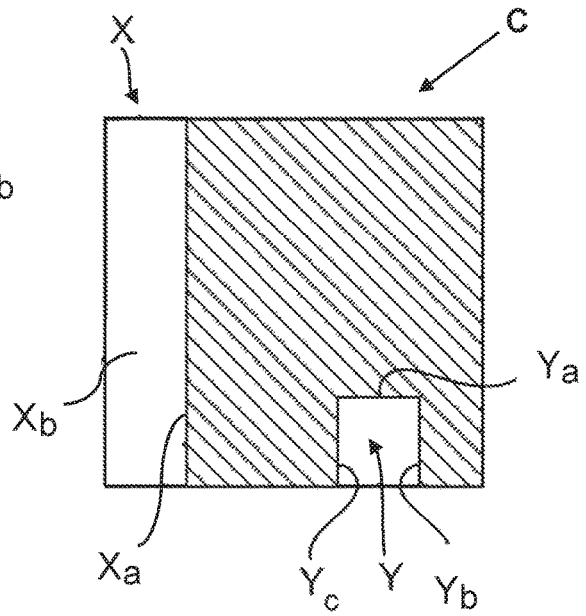
FIG. 2*d* is a sectional view taken along line 2*d*-2*d* of FIG. 2*c;*

As illustrated in FIG. 2*c*, the channel X comprises a bottom-wall Xa parallel to the plane of its respective cube face Fa, a first sidewall Xb extending upwardly in perpendicular to the bottom-wall Xa and a second sidewall Xc extending upwardly in perpendicular to the bottom-wall Xa and in parallel to sidewall Xb. Sidewall Xb and adjacent cube face Fa, form a ridge Rx. The width of bottom-wall Xa and the width of ridge Rx are substantially equal, both marked 'a' as shown in FIG. 2*a*. Rx is sized to snuggly fit in channel X, preferably snap-fitted therein. The same applies mutatis-mutandis with regard to the channels Y and Z, as shown.

It will be appreciated by those skilled in the art that channels X, Y and Z of a cubic element according to an embodiment of the present invention may be shaped in various geometric shapes, such as trapezoidal with a bottom wall and 2 angular sidewalls, triangular with only 2 angular sidewalls, semi-round with a single semi-round wall, etc., and ridges Rx, Ry and Rz complementarily shaped to snuggly fit each in a respective channel in a second cube element. It will be further appreciated that each channel on a first cube element may be shaped in a different geometric shape and each ridge on a second cube element may be complementarily shaped to snuggly fit a respective channel on the first cube element, as disclosed above in respect of a rectangular shaped channel.

Figure 3:
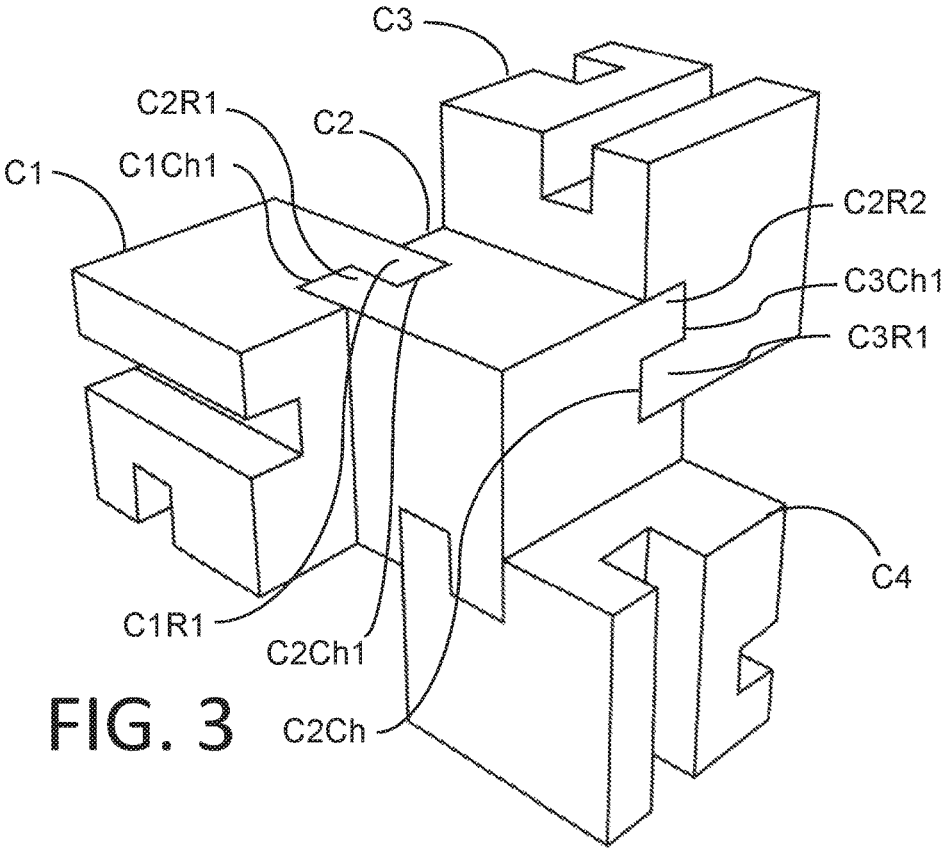
FIG. 3 illustrates a simple example of interlocking of a plurality of cubic elements according to the an embodiment of the present invention to form a three-dimensional toy structure.

As illustrated in FIG. 3, a plurality of cube elements C1-C4 may be assembled or interlocked in various positions, wherein a ridge C1R1 of cube C1 snugly fit in channel C2Ch1 of cube C2, ridge C2R1 of cube C2 snugly fit in channel C1Ch1 of cube C1, ridge C2R2 of cube C2 snugly fit in channel C3Ch1 of cube C3, ridge C3R1 of cube C3 snugly fit in channel C2Ch2 of cube C2, etc. Thus, a construction toy is assembled.

While the cubic element proposed according to the present invention can be made of a solid material, such as wood or by a plastic molding, according to a further aspect of the invention it would advantageously be hollow, composed of three, identical, plastic-injected sections, cemented or otherwise attached to each other.

Figure 4A:
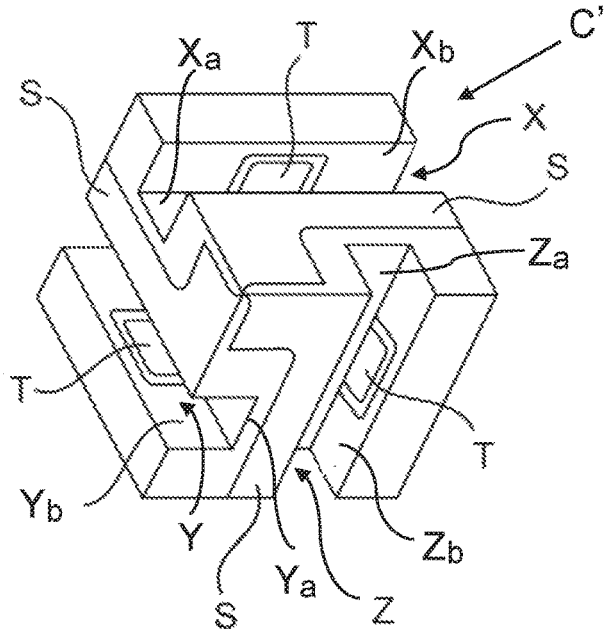
FIG. 4*a* is a three-dimensional isometric projection of a top and side view of a cubic element according to a second preferred embodiment of the present invention, namely composed of three identical element-sections.
Figure 4B:
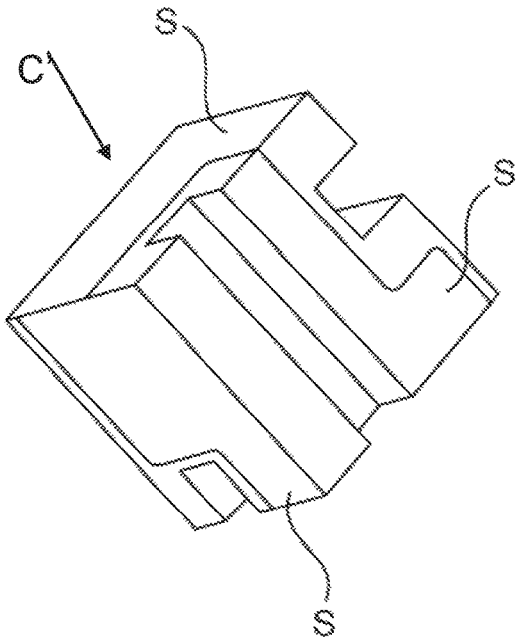
FIG. 4*b* is a three-dimensional isometric projection of a bottom and side views of the cubic element of FIG. 4*a;*
Figure 5A:
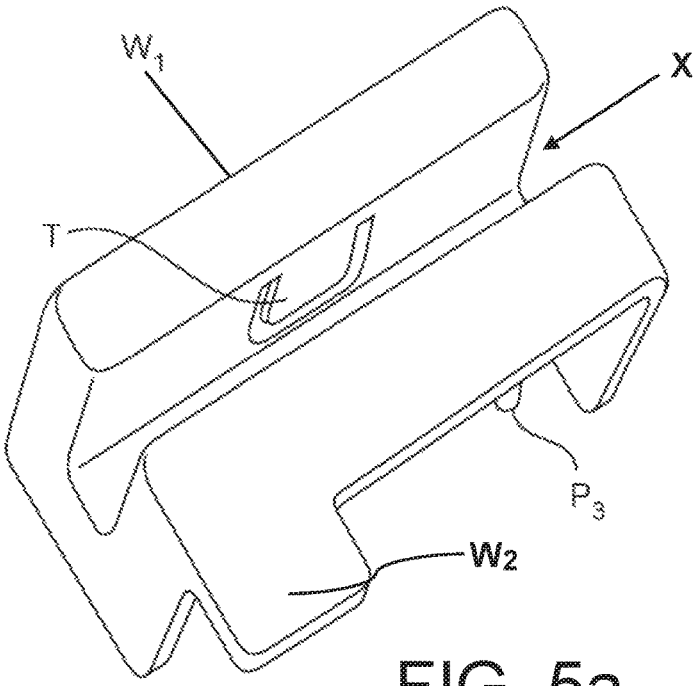
FIG. 5*a* is a three-dimensional isometric projection view of the element-section.
Figure 5B:
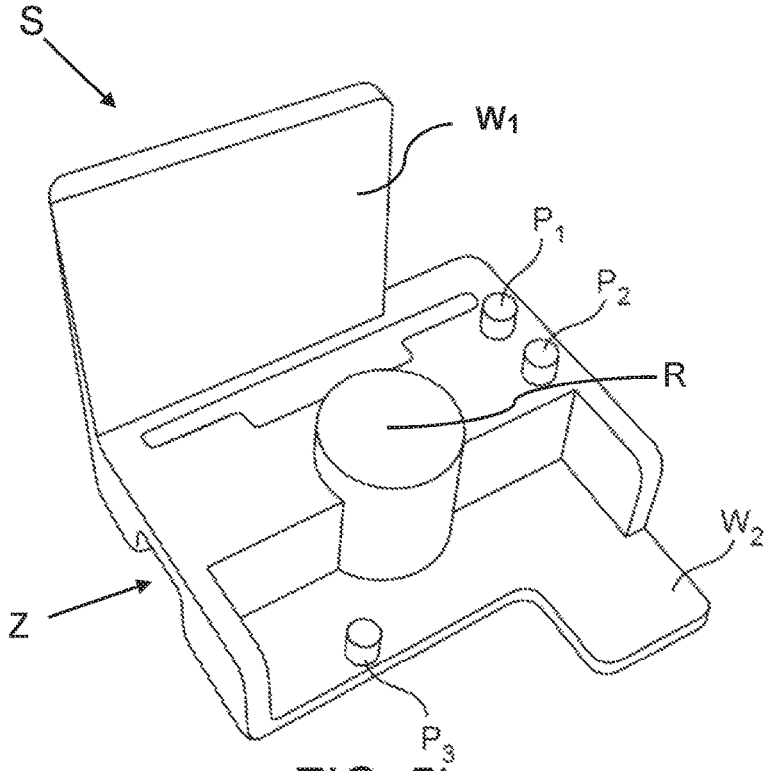
FIG. 5*b* is a three-dimensional isometric projection of the element-section of FIG. 5*a* seen in a rotated direction.
Figure 5C:
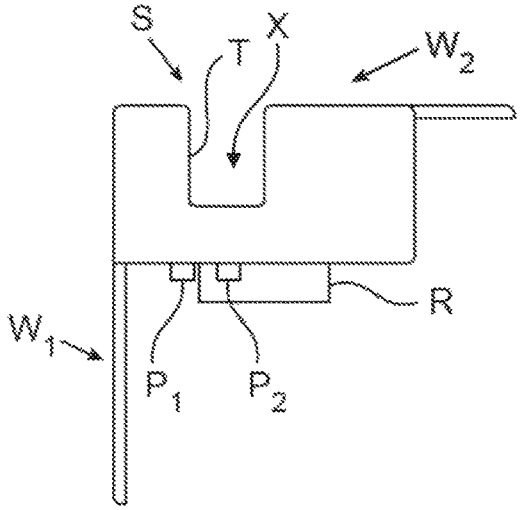
FIG. 5*c* is a first side-view of the element-section of FIGS. 5*a* and 5*b;*
Figure 5D:
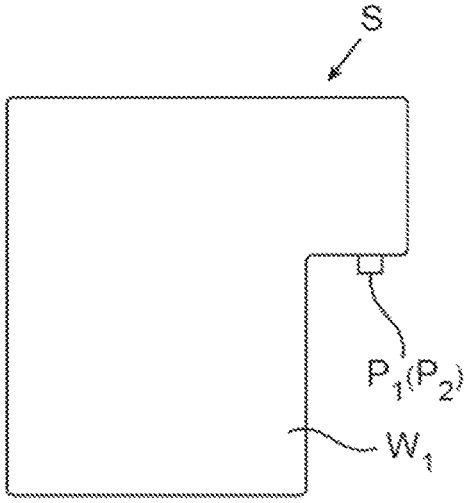
FIG. 5*d* is a front-view of the element-section of FIG. 5*c;*
Figure 5E:
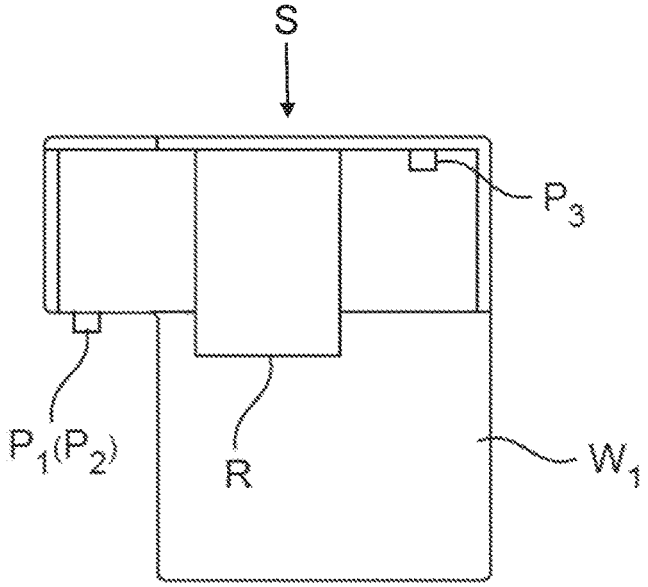
FIG. 5*e* is a rear-view of the element-section of FIG. 5*c;*
Figure 5F:
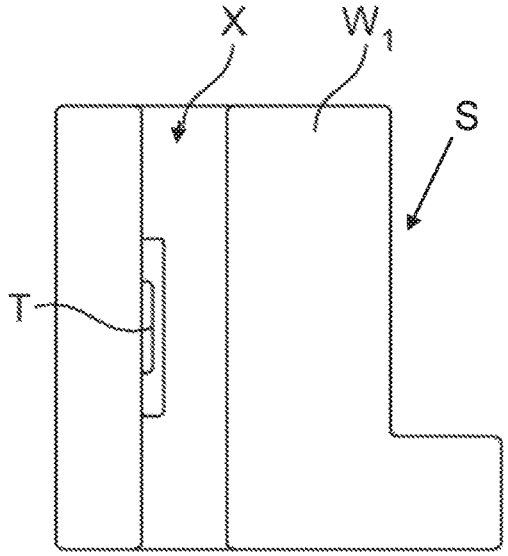
FIG. 5*f* is a top-view of the element-section of FIG. 5*c;*
Figure 5G:
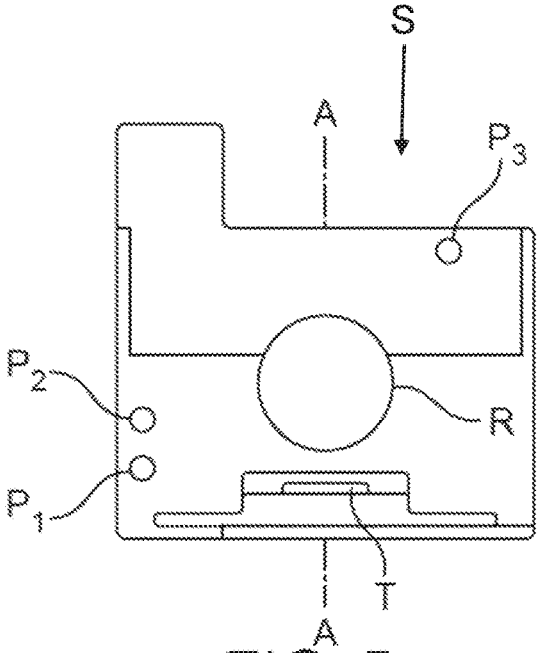
FIG. 5*g* is a bottom-view of the element-section of FIG. 5*c;*
Figure 5H:
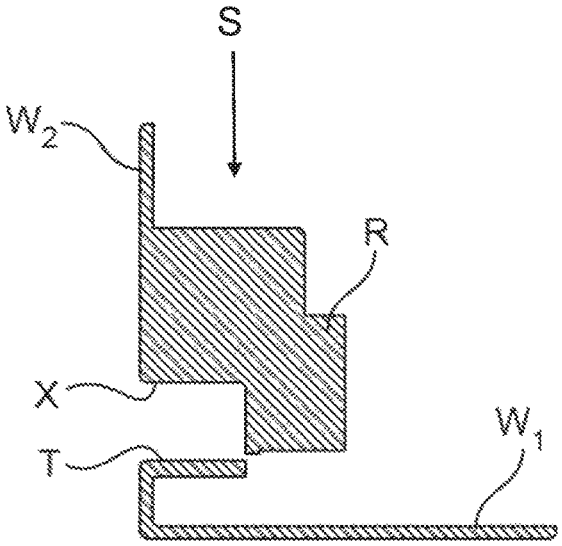
FIG. 5*h* is a sectional view taken along line A-A of FIG. 5*g;*

Referring now to FIGS. 4*a* and 4*b*, it will be readily noticed that the cubic element generally designated C—is much the same as that of FIGS. 2*a* and 2*b*, but for the fact that it is hollow and composed of three identical element-sections denoted S, which are produced separately and put together as will be described in greater detail below.

Optionally, as illustrated in FIG. 4*a*, at least one flexible tongue T is provided at each one of channels X, Y and Z, preferably at sidewall Xb of channel X (as shown in FIG. 2C) and respectively at sidewall Yb of channel Y and sidewall Zb of channel Z. The function of these tongues is to create a friction force between a ridge of one cube element to a channel in a second cube element when the two cube elements are interconnected in the constructing process.

In more detail, as seen in FIGS. 5*a*-5*h*, the element-section S generally comprises two wings W1 and W2. Wing W1 is flat and wing W2 is profiled, both formed integrally with the element-section S. Each element-section S further comprises a channel (X, Y, or Z (sized, adapted and configured as disclosed above), each including at least one flexible tongue T, which is integrally formed with a side-wall of the channel.

Each element-section S is further provided with two juxtaposed pins P1 and P2 disposed at the internal side of element-section 5, and a third pin P3 disposed diagonally opposite pins P1 and P2 on the internal side of wing W2; the distance between pins P1 and P2 on a first element-section S is sized and configure to receive in a snap-fit manner pin P3 of a second element-section S upon the assembling of the first cube element to the second cube element.

The cylindrical projection P shown in FIGS. 5*b*, 5*c*, 5*e*, 5*g* and 5*h* has no functional purpose. It serves only to enhance the plastic-injection process by which element-section S is fabricated according to this exemplified embodiment of the present invention.

It will be now readily understood by a professional reader that three element-sections S can be put together, cemented to each other in any known manner, thus forming a hollow cube as shown in FIG. 4*a*.

Dominoes is a game played with rectangular "domino" tiles each having a line dividing its face into two square ends. Each end is marked with a set of spots or is blank. The traditional Sino-European domino set consists of 28 domino tiles, featuring all combinations of spot counts between zero and six. Using the cubic elements according to the present invention in place of the tiles in the conventional Dominoes game provides each element of the game with 6 planes marked with spots rather than only a single plane of the Dominoes tiles. The system of spots of the cubic element will necessarily be different from the system of spots of the conventional Dominoes system, yet based on the same principle.

Figure 6A:
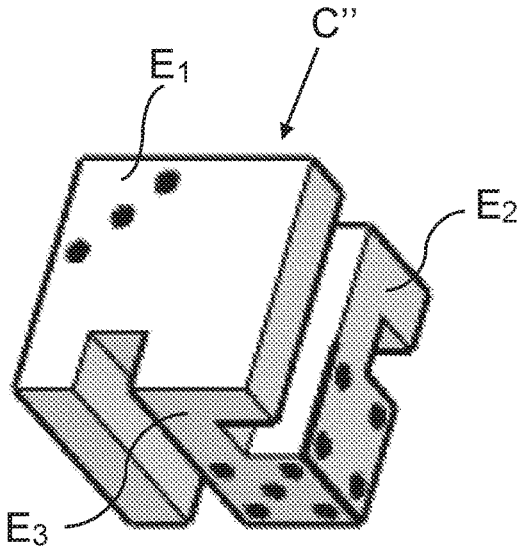
FIG. 6*a* is a three-dimensional isometric projection of a top and right side views of a cubic element according to a preferred embodiment of a the present invention illustrating spots on its top, front and right surfaces.
Figure 6B:
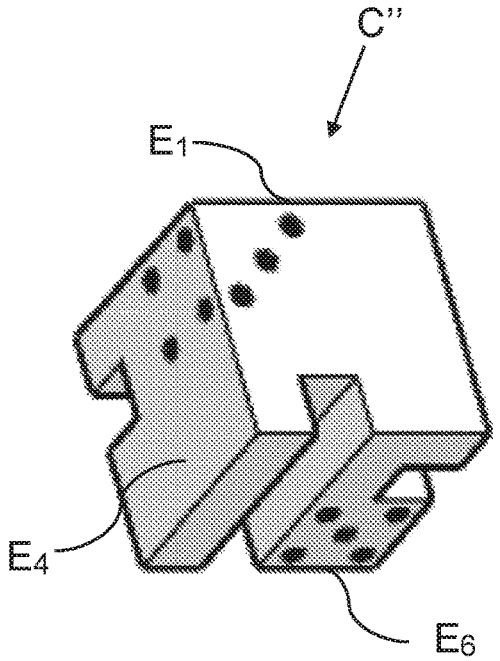
FIG. 6*b* is a three-dimensional isometric projection of a top and left side views of a cubic of the element of FIG. 6*a* seen in a rotated direction illustrating spots on its top, front and left surfaces; and, FIG. 7 illustrates a simple example of interlocking of a plurality of cubic elements according to an embodiment of the present invention to form a three-dimensional "Dominoes" game structure illustrating spots on the cubic element external surfaces.

Referring to FIGS. 6*a* and 6*b*, there is shown a cube element C" according to the present invention, marked with spots much like the spots on Dominoes tiles, one set of spots on each external surface of the cube element. A set of 3 spots is marked on surface E1, a set of 4 spots is marked on surface E2 and a set of 5 spots are marked on surface E3. FIG. 6*b* which shows cube element C" of FIG. 6*a* rotated slightly to the right, illustrates a set of 4 spots on surface E4. Each of surfaces E5 and E6 are marked with a set of spots (not shown). It will be appreciated by those skilled in the art that the external surfaces of each cube element may be marked with different sets of spots depending on the rules adapted by the manufacturer as he deem fit.

Figure 7:
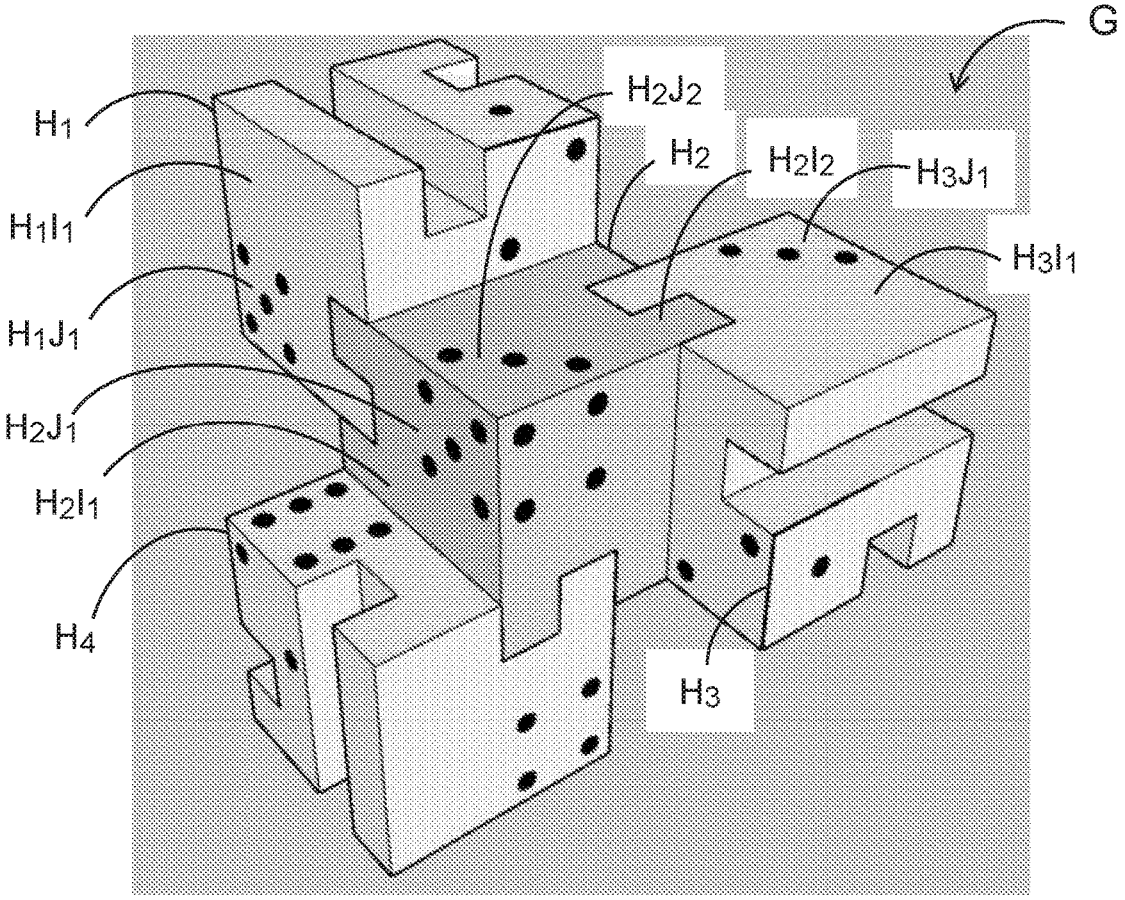

Referring to FIG. 7, there is illustrated a construction G which is assembled with 4 cube elements H1-H4, as illustrated in FIG. 3 above. According to the rules of the game, the user assembling construction G, selects a first cube element H1 comprising one external surface H1I1 marked with a set of 5 spots H1J1, a second cube element H2 comprising a corresponding external surface H2I1 marked with a set of 5 spots H2J1, and interlocks these 2 cube elements so that corresponding surfaces H1I1 and H2J1 having the same set of 5 spots H1J1 and H2J1, are aligned. Similarly, the user interlocks cube-elements H3 and H2 so that corresponding surfaces H2I2 and H3J1 having the same set of 3 spots H2J2 and H3J1, are aligned.

According to the present invention the cube elements marked on each external surface with a set of spots according to rules determined by the manufacturer provides a novel 3D cubic "Dominoes" game with many more options and possibilities to play this game than the conventional one.

Those skilled in the art to which the present invention pertains will readily appreciate that many changes, modifications and variations can be applied to the embodiments thereof as heretofore described without departing from its scope as defined in and by the appended claims.

It will further be appreciated that the invention is not limited to what has been described hereinabove merely by way of example, rather, it is limited solely by the claims which follow.

The invention claimed is:

1. A construction toy comprising:

a cubic element, wherein in a first orientation the cubic element comprises:

a left side, a right side, a front side, a back side, a top side, and a bottom side; a front channel that is recessed into the front side, that is oriented horizontally, that is disposed closer to the bottom side than the top side, and that opens through the left side and the right side; a right channel that is recessed into the right side, that is oriented vertically, that is disposed closer to the back side than the front side, and that opens through the bottom side and the top side; and a top channel that is recessed into the top side, that is oriented horizontally, that is disposed closer to the left side than the right side, and that opens through the front side and the back side;

wherein a front ridge is defined between the front channel and the bottom side, a right ridge is defined between the right channel and the back side, and a top ridge is defined between the top channel and the left side; and wherein the front channel, the right channel, and the top channel share a common channel size and shape, wherein the front ridge, the right ridge, and the top ridge share a common ridge size and shape, and wherein the common ridge size and the common channel size and shape are complementary with each other.

2. The construction toy of claim 1, further comprising a second cubic element comprising a same cube size and cube shape as the cubic element, wherein the front ridge, the right ridge, and the top ridge of the second cubic element each complementary fit into every one of the front channel, the right channel, and the top channel of the cubic element.

3. The construction toy of claim 2, wherein when the cubic element is in the first orientation and any of the front ridge, the right ridge, and the top ridge of the second cubic element is disposed in the top channel of the cubic element, the second cubic element cantilevers leftward from the cubic element.

4. The construction toy of claim 1, wherein each channel comprises a bottom wall parallel to a respective face of the cubic element into which the channel is recessed, and two parallel sidewalls extending upward perpendicular to the bottom wall.

5. The construction toy of claim 4, wherein each ridge comprises a width equal to a distance between the two parallel sidewalls of each channel.

6. The construction toy of claim 1, wherein each channel comprises a trapezoidal shape comprising a bottom wall and two angular sidewalls extending upward from the bottom wall.

7. The construction toy of claim 1, wherein the cubic element is formed of a solid material, the solid material being wood or plastics.

8. The construction toy of claim 1, wherein each cubic element comprises three identical sections configured to be attached to each other, each section comprising:

a first flat wing integrally formed with the section;

a second profiled wing integrally formed with the section;

a first pin and a second pin juxtaposed and disposed at the internal side of the section; and a third pin disposed diagonally opposite the first pin and the second pin on an internal side of the second profiled wing;

wherein a distance between the first pin and the second pin on each section is sized and configure so as to receive in a snap-fit manner the third pin of another section upon the assembling of each section to another section.

9. The construction toy of claim 8, wherein the three identical sections are attached to each other via cement.

10. The construction toy of claim 8, wherein the three identical sections are attached to each other via the snap-fit manner.

11. The construction toy of claim 1, further comprising a flexible tongue projecting from a sidewall of at least one of the front channel, the right channel, and the top channel.

12. The construction toy of claim 11, wherein the flexible tongue is integrally formed with the sidewall.

13. A dominoes game comprising the construction toy of claim 1, wherein the cubic element is one of a plurality of the cubic elements, wherein each cubic element comprises dominoes markings on each side of the cubic element; and wherein a first cubic element of the plurality of cubic elements is configured to interlock with a second cubic element of the plurality of cubic elements by snugly disposing a ridge of the first cubic element into a channel of the second cubic element so as to align a face of the first cubic element with a face of the second cubic element, wherein on each these aligned faces identical dominoes markings of the dominoes markings are present.

14. A method for forming the cubic element of claim 1, the method comprising:

providing a first element section, a second element section, and a third element section of the cubic element, each element section comprising a first flat wing integrally formed therewith, a second profiled wing integrally formed therewith, a first pin and a second pin juxtaposed with each other and disposed at an internal side of each element section, and a third pin disposed diagonally opposite the first pin and the second pin on an internal side of the second profiled wing;

sizing and configuring a distance between the first pin and the second pin on each element section so as to receive in a snap-fit manner a third pin of another element section;

assembling the first element section to the second element section to form a subassembly; and assembling the third element section to the subassembly to form the cubic element.

15. The method for forming the cubic element of claim 14, wherein assembling the first element section to the second element section to form a subassembly comprises cementing the first element section to the second element section, and wherein assembling the third element section to the subassembly to form the cubic element comprises cementing the third element section to the subassembly.

* * * * *